US006695165B2

(12) United States Patent
Park

(10) Patent No.: US 6,695,165 B2
(45) Date of Patent: Feb. 24, 2004

(54) DOOR DEVICE HAVING A REDUCED ACTION RANGE

(75) Inventor: Jae-hoo Park, Kyungki-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/115,128

(22) Filed: Apr. 4, 2002

(65) Prior Publication Data

US 2003/0000146 A1 Jan. 2, 2003

(30) Foreign Application Priority Data

Jun. 29, 2001 (KR) ..... 2001-38184

(51) Int. Cl.[7] ..... B65D 51/04; B65D 43/14; E05D 15/58; A47F 3/00

(52) U.S. Cl. ..... 220/812; 220/825; 220/815; 220/811; 220/831; 220/810; 312/139.1; 312/138.1; 49/260; 49/258

(58) Field of Search ..... 220/817, 818, 220/813, 811, 815, 825, 831; 312/138.1, 139.1, 322, 323; 49/246, 254, 255, 257, 258, 260

(56) References Cited

U.S. PATENT DOCUMENTS 479,857 A * 8/1892 Tettelbach ..... 126/190
1,115,345 A * 10/1914 Steuernagel ..... 312/109
1,529,601 A * 3/1925 Lyons ..... 49/197
1,855,953 A * 4/1932 Friedrich ..... 312/296
2,590,028 A * 3/1952 Miller ..... 312/323
6,129,237 A * 10/2000 Miyahara ..... 220/812
2001/0052524 A1 * 12/2001 Ichimaru et al. ..... 220/815
2002/0005411 A1 * 1/2002 Asami ..... 220/815
2002/0179487 A1 * 12/2002 Au et al. ..... 206/752

* cited by examiner

*Primary Examiner*—Lee Young
*Assistant Examiner*—James Smalley
(74) *Attorney, Agent, or Firm*—Sughrue Mion, PLLC

(57) ABSTRACT

A door device for opening and closing an opening of a collecting case includes a door body for opening and closing the opening. A first hinge and a second hinge are disposed at one side of the door body at a predetermined distance from each other. A first guide rail is disposed at an interior wall of the collecting case for a predetermined length for guiding the door body to slide into and out from the collecting case by guiding the first hinge to move inwardly and outwardly with respect to the collecting case when the door is opened and closed; and a second guide rail is disposed at an interior wall of the collecting case for a predetermined length for guiding the second hinge to simultaneously rotate when the door body slides into and out from the collecting case.

3 Claims, 3 Drawing Sheets

DOOR DEVICE HAVING A REDUCED ACTION RANGE

BACKGROUND OF THE INVENTION

1. Field of the Invention

An apparatus consistent with the present invention relates to a door device and, more particularly, to a door device capable of moving freely in a narrow space.

2. Description of the Related Art

Generally, a door device is disposed at a collecting case such as a TV decorative case. The above door device needs to have a predetermined space in relation to opening and closing of the door device when formed as a hinged type.

On the other hand, the hinged type door device can cause inconvenience for a user due to an opened door when the user opens the door. For solving the problem, a door device 10 has been applied to a collecting case 20 as shown in FIGS. 1 and 2.

The door device 10 comprises a door 11 having a hinge 11*a* for opening and closing an open area 21 of the collecting case 20, and a rail 13 for supporting the door 11 to be slid into the collecting case 20. The hinge 11*a* rotates and slides on the rail 13. The rail 13 is formed at an interior wall of the collecting case 20. The rail 13 should have a longer length than at least a height of the door 11 so that the door 11 can be completely inserted into the collecting case 20.

In the above construction, to open the door 11, a user rotates the door 11 about 90° to a direction of A as shown in FIG. 1. Then, the door 11 is maintained in parallel to the rail 13. Next, as shown in FIG. 2, if the user pushes the door 11 to a direction B, the door 11 is completely inserted into the collecting case 20. Therefore, the open area 21 of the collecting case 20 is open.

However, in the conventional door device 10 having the above construction, the door 11 should be lifted for about 90° so that the door 11 can be inserted along the rail 13. Accordingly, the conventional door device cannot be used in a narrow space, since there should be enough space for moving the door 11 through 90°.

Moreover, when the length of the door 11 is long, the rail 13 should be long also. Thus, there is a limitation in the height of the door 11.

In addition, there is a problem of degrading a product by applying the door device 10, due to a rigid action that the user rotates the door 11 for 90° and pushes the door 11 over and over again.

SUMMARY OF THE INVENTION

An apparatus consistent with present invention has been made to overcome the above-mentioned problems of the related art. Accordingly, it is an aspect of the present invention to provide a door device capable of opening and closing a door by a natural action and at the same time reducing an action range of the door.

The above aspect is accomplished by a door device for opening and closing an open area of a collecting case, comprising a door body for opening and closing the opening; a first hinge and a second hinge disposed at one side of the door body for a predetermined distance from each other; a first guide rail adapted to be disposed at an interior wall of the collecting case for a predetermined length for guiding the door body to slide into and out from the collecting case by guiding the first hinge to move inwardly and outwardly with respect to the collecting case when the door body is opened and closed; and a second guide rail adapted to be disposed at an interior wall of the collecting case for a predetermined length for guiding the second hinge to simultaneously rotate when the door body slides into and out from the collecting case.

Moreover, the first guide rail has a stopper disposed in contact with the first hinge at an end of the first guide rail for preventing the first hinge from moving when the door body is open.

In addition, preferably, but not necessarily, the first guide rail comprises a first curved part for guiding the first hinge when the door body rotates about the second hinge for opening the door body, and a second curved part for guiding the first hinge while the door body is being inserted into the collecting case by rotating and sliding when the second hinge rotates and slides on the second guide rail following the rotation of the door body.

Furthermore, preferably, but not necessarily, the first guide rail is sloped downwardly from the opening to an inside of the collecting case.

In addition, it is advisable that the second guide rail is sloped upwardly from the open area to the inside of the collecting case.

Moreover, it is recommended that the first and the second guide rails are disposed by forming a hole for a predetermined depth and a length at a support panel formed inside of the collecting case.

Furthermore, a door device to accomplish the above aspect comprises a collecting case having an opening formed therein; a door body for opening and closing the opening; a first hinge and a second hinge formed at one side of the door body at a predetermined distance from each other; a first guide rail disposed at an interior wall of the collecting case for a predetermined length for guiding the first hinge to slide inwardly and outwardly with respect to the collecting case when the door body is opened and closed; and a second guide rail disposed at an interior wall of the collecting case for a predetermined length for guiding the second hinge to simultaneously rotate when the door body slides into and out from the collecting case.

BRIEF DESCRIPTION OF THE DRAWINGS

The above-mentioned aspect and the features of the present invention will be more apparent by describing an illustrative, non-limiting embodiment of the present invention by referring to the accompanying drawings, in which.

DESCRIPTION OF AN ILLUSTRATIVE EMBODIMENT

Figure 1:
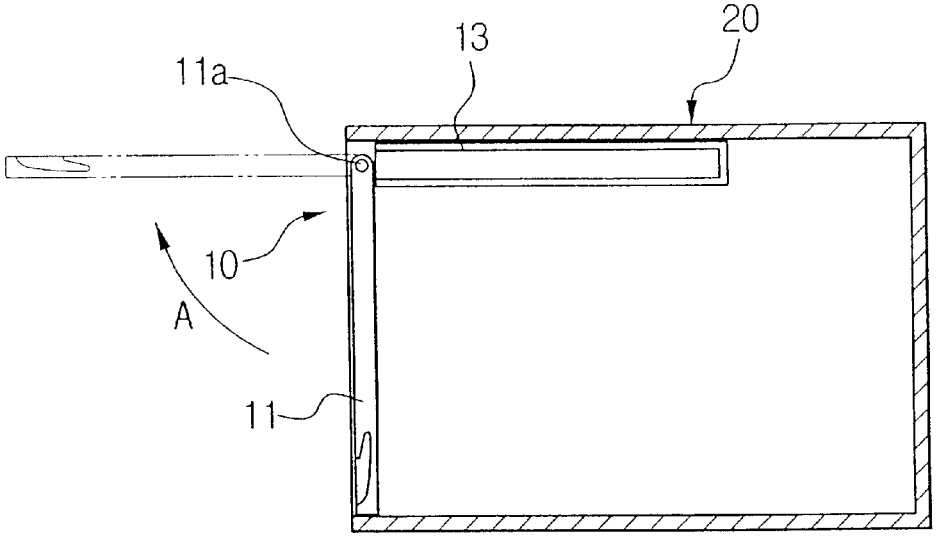
FIG.1 PRIOR ART
FIGS. 1 and 2 are schematic side views showing a conventional door device.
Figure 2:
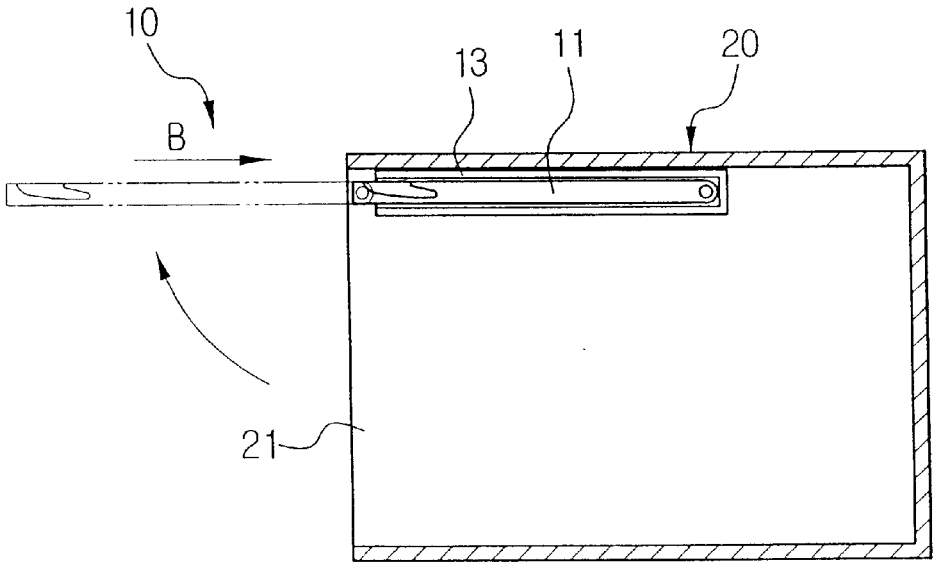
FIG.2 PRIOR ART
Figure 3:
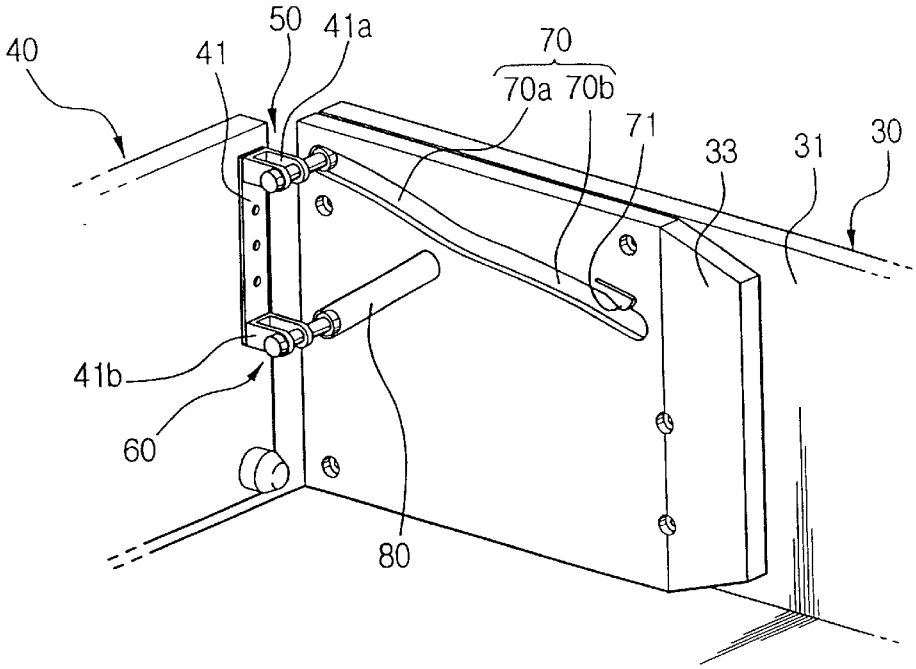
FIG. 3 is a schematic perspective view showing a door device according to an illustrative, non-limiting embodiment of the present invention.

Referring to FIG. 3, a door device according to an illustrative, non-limiting embodiment of the present invention comprises a collecting case 30; a door body 40 for opening and closing an opening of the collecting case 30; a first hinge 50 and a second hinge 60 installed at the door body 40; and first and second guide rails 70 and 80, respectively.

The collecting case 30 has a predetermined space defined therein such as a TV embracing case and a general decorative case. The collecting case 30 has an opening that is opened and closed by the door body 40.

A support bracket 41 is installed at one side of the door body 40 for supporting the first hinge 50 and the second hinge 60. A first support unit 41*a* is installed at an upper part of the support bracket 41 for supporting the first hinge 50, and a second support unit 41*b* is installed at a lower part of the support bracket 41 for supporting the second hinge 60. Thus, the first and the second hinges 50 and 60 are disposed up and down at the door body 40 at a predetermined distance from each other.

The first and the second guide rails 70 and 80 are disposed at a support panel 33 disposed at an interior wall 31 of the collecting case 30. In this case, each guide rail 70 and 80 can be formed at the interior wall 31 of the collecting case 30 without forming the separate support panel 33.

The first guide rail 70 is sloped downwardly from the opening to an inside of the collecting case for a predetermined length. The first guide rail 70 guides the first hinge 50 to move into and out from the collecting case 30 when the door body 40 is opened and closed. Thus, an upper part of the door body 40 moves into and out from the collecting case 30 as the first hinge 50 is moved along the first guide rail 70. In addition, a stopper 71 is disposed at an interior end of the first guide rail 70 for preventing the first hinge 50 from moving when the door body 40 is opened. The first hinge 50 is forcefully slid into the stopper 71 when the first hinge 50 contacts with the stopper 71, and the first hinge 50 is placed at the end of the first guide rail 70. The first guide rail 70 can be formed at the support panel 33 by making a groove for a predetermined depth and a length.

The second guide rail 80 is sloped upwardly from the opening to the inside of the collecting case 30 for a predetermined length. The second guide rail 80 has a greater sloping degree compared to the first guide rail 70, and the length of the second guide rail 80 is about a half of the first guide rail 70. The second guide rail 80 guides movement and rotation of the second hinge 60 so that the door body 40 can rotate while moving out from the collecting case 30. Thus, when the door body 40 is opened, firstly, the second hinge 60 alone rotates, and the first hinge 50 rotates and slides along the first guide rail 70. Then, after rotation of the door body 40 for a certain degree, the second hinge 60 rotates and slides on the second guide rail 80 as the second hinge 60 changes its location, and also the first hinge 50 rotates and slides. Accordingly, the door body 40 is inserted into the collecting case 30 by rotating in close contact to the upper part of the collecting case 30, when the door body 40 is opened. The second guide rail 80 also can be formed at the support panel 33 by making a groove for a predetermined depth and a length in a manner similar to the first guide rail 70.

As described above, the door body 40 is substantially opened by a two-step open action. For this end, preferably, but not necessarily, the first guide rail 70 has a first curved part 70*a* for guiding a movement of the first hinge 50 at the first step as the door body 40 is centering about the second hinge 60, and a second curved part 70*b* for guiding a movement of the first hinge 50 while the second hinge 60 then rotates and slides after the first step is finished. Therefore, the first guide rail 70 is the shape of a repeated curve, and the second guide rail 80 is linear in shape.

The description of the door device according to the illustrative embodiment of the present invention is as follows.

Figure 4:
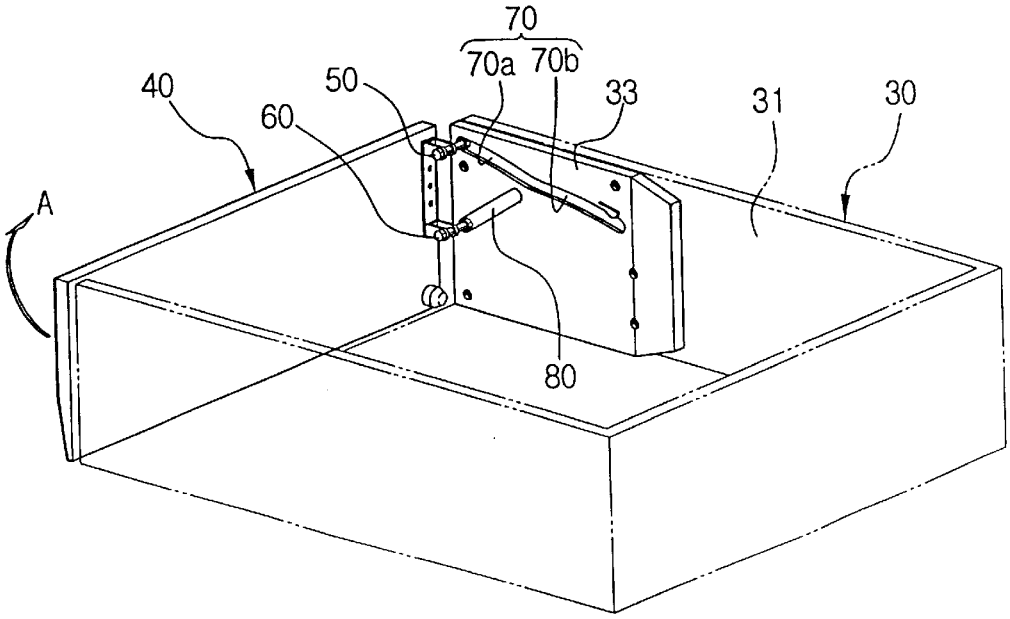
FIGS. 4 through 6 are schematic perspective views showing the operation of the door device shown in FIG. 3.
Figure 5:
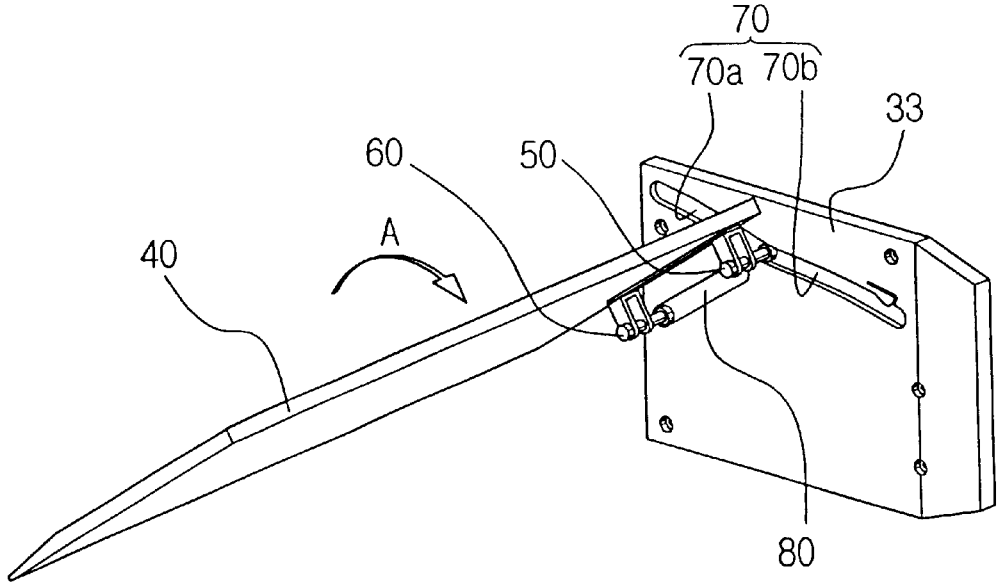

First of all, as shown in FIG. 4, the door body 40 is rotated in a direction of A for opening the opening of the collecting case 30. Next, the door body 40 firstly, rotates in the direction of 'A' about the second hinge 60 as shown in FIG. 5. At this time, as the first hinge 50 moves along the first curved part 70*a* of the first guide rail 70, the upper part of the door body 40 is inserted into the collecting case 30 for a predetermined depth.

Figure 6:
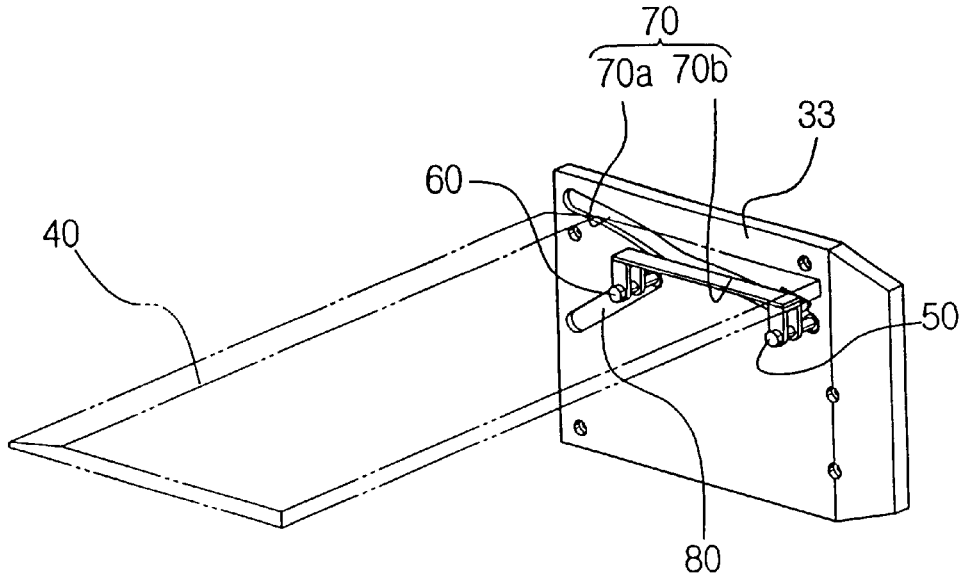

On the other hand, if the door body 40 further rotates in the direction of A after rotating for a certain degree, then the second hinge 60 moves along the second guide rail 80 as shown in FIG. 6. In addition, the first hinge 50 moves along the second curved part 70*b* of the first guide rail 70. Thus, the door body 40 rotates about the second hinge 60 and simultaneously the door body 40 moves to a ceiling of the collecting case 30, and an upper part of the door body 40 is entirely inserted into the collecting case 30. That is, the door body 40 is rotated about 90° from its original position and inserted to a close contact to the inside ceiling of the collecting case 30.

Furthermore, the first hinge 50 is stopped by the stopper 71 formed at the end of the first guide rail 70, so that the door body 40 does not free fall even when the user does not hold the door body 40 while in the state shown in FIG. 6.

On the other hand, as described above, since the door body 40 operates in two steps: the first step being that the door body 40 alone rotates about the second hinge 60 and the second step being that the door body 40 rotates and moves about the second hinge 60, the opening action of the door body 40 is very smooth and can be easily operated with a minor effort.

Moreover, since the door body 40 rotates and at the same time is inserted into the collecting case 30, the operating space of the door body 40 at the outer side thereof can be minimized.

On the other hand, in the illustrative embodiment of the present invention, the first and the second guide rails 70 and 80 are grooves formed at the support panel 33, but it is only an example. Thus, the first and the second guide rails 70 and 80 can be formed by disposing a rail member.

According to the door device of the present invention having the above construction, as the door body 40 is constructed to be rotated and simultaneously pushed to be opened and closed, the opening and closing of the door body is soft and natural. Thus, the level of the product having the door device of the present invention is upgraded.

Moreover, by reducing the rotation range of the door body 40, the place for installing the product is not limited, and the product can be placed in a narrow place.

It is contemplated that numerous modifications may be made to the door device of the present invention without departing from the spirit and scope of the invention as defined in the following claims.

What is claimed is:

1. A door device for opening and closing an opening of a collecting case, comprising:

a door body for opening and closing the opening;

a first hinge and a second hinge disposed at one side of said door body at a predetermined distance from each other;

a first guide rail adapted to be disposed at an interior wall of the collecting case for a predetermined length for guiding said door body to slide into and out from the collecting case by guiding said first hinge to move inwardly and outwardly with respect to the collecting case when said door body is opened and closed; and a second guide rail adapted to be disposed at an interior wall of the collecting case for a predetermined length for guiding said second hinge to simultaneously rotate when said door body slides into and out from the collecting case, wherein said first guide rail has a stopper disposed in contact with said first hinge at an end of said first guide rail for preventing said first hinge from moving when said door body is open, wherein said first guide rail further comprises:

a first curved part for guiding said first hinge when said door body rotates about said second hinge for opening said door body; and a second curved part for guiding said first hinge while said door body is being inserted into the collecting case by rotating and sliding when said second hinge rotates and slides on said second guide rail following the rotation of said door body, said first guide rail being sloped downwardly from the opening to an inside of the collecting case, wherein said second guide rail is linearly sloped upwardly over an entire length thereof from the opening to the inside of the collecting case, and wherein said first and said second guide rails are disposed by forming a groove for a predetermined depth and a length at a support panel formed inside of the collecting case.

2. A door device, comprising:

a collecting case having an opening formed therein;

a door body for opening and closing said opening;

a first hinge and a second hinge formed at one side of said door body at a predetermined distance from each other;

a first guide rail disposed at an interior wall of said collecting case for a predetermined length for guiding said first hinge to slide inwardly and outwardly with respect to said collecting case when said door body is opened and closed; and a second guide rail disposed at an interior wall of said collecting case for a predetermined length for guiding said second hinge to simultaneously rotate when said door body slides into and out from said collecting case, wherein said first guide rail has a stopper disposed in contact with said first hinge at an end of said first guide rail for preventing said first hinge from moving when said door body is open, wherein said first guide rail further comprises:

a first curved part for guiding said first hinge when said door body rotates about said second hinge for opening said door body; and a second curved part for guiding said first hinge while said door body is being inserted into said collecting case by rotating and sliding when said second hinge rotates and slides on said second guide rail following the rotation of said door body, said first guide rail being sloped downwardly from said opening to an inside of said collecting case, wherein said second guide rail is linearly sloped upwardly over an entire length thereof from said opening to the inside of said collecting case, and wherein said first and said second guide rails are disposed by forming a groove for a predetermined depth and a length at a support panel formed inside of said collecting case.

3. A door device for opening and closing an opening of a collecting case, comprising:

a door body for opening and closing the opening;

a first hinge and a second hinge disposed at one side of said door body at a predetermined distance from each other;

a first guide rail adapted to be disposed at an interior wall of the collecting case for a predetermined length for guiding said door body to slide into and out from the collecting case by guiding said first hinge to move inwardly and outwardly with respect to the collecting case when said door body is opened and closed; and a second guide rail, which is linear in shape over an entire length therof, adapted to be disposed at an interior wall of the collecting case for a predetermined length for guiding said second hinge to simultaneously rotate when said door body slides into and out from the collecting case, wherein said first guide rail comprises:

a first curved part for guiding said first hinge when said door body rotates about said second hinge for opening said door body; and a second curved part, having the same shape as the first curved part, for guiding said first hinge while said door body is being inserted into the collecting case by rotating and sliding when said second hinge rotates and slides on said second guide rail following the rotation of said door body.

* * * * *